US011839280B2

(12) United States Patent
Tuiono

(10) Patent No.: US 11,839,280 B2
(45) Date of Patent: Dec. 12, 2023

(54) SUITCASE TRAY ASSEMBLY

(71) Applicant: Fia Tuiono, Redwood City, CA (US)

(72) Inventor: Fia Tuiono, Redwood City, CA (US)

( * ) Notice: Subject to any disclaimer, the term of this patent is extended or adjusted under 35 U.S.C. 154(b) by 59 days.

(21) Appl. No.: 17/523,388

(22) Filed: Nov. 10, 2021

(65) Prior Publication Data

US 2023/0146511 A1 May 11, 2023

(51) Int. Cl.
*A45C 15/00* (2006.01)
*A47B 3/10* (2006.01)

(52) U.S. Cl.
CPC ..... *A45C 15/00* (2013.01); *A47B 3/10* (2013.01); *A45C 2200/20* (2013.01)

(58) Field of Classification Search
CPC ..... A45C 15/00; A45C 2200/20; A47B 3/10
See application file for complete search history.

(56) References Cited

U.S. PATENT DOCUMENTS 5,603,477 A * 2/1997 Deutsch ..... B60N 3/106 248/292.12
6,471,019 B1 * 10/2002 Miller ..... A45C 15/00 190/111
7,350,857 B2 * 4/2008 Bishop ..... A45C 9/00 297/188.1
9,282,795 B2 3/2016 King
9,295,320 B1 * 3/2016 McManus ..... A45F 5/021
9,474,346 B2 10/2016 Simon
D782,193 S 3/2017 Jose
10,405,627 B2 9/2019 Boland, III
2011/0209960 A1 * 9/2011 MacLean, III ..... A45C 13/28 190/115
2014/0299428 A1 10/2014 Gadbois
2015/0027836 A1 1/2015 Zhou
2017/0238669 A1 8/2017 Jose

FOREIGN PATENT DOCUMENTS

CN 108835810 A * 11/2018
WO WO03079843 10/2003

* cited by examiner

*Primary Examiner* — Tri M Mai

(57) ABSTRACT

A suitcase tray assembly includes a suitcase has a pair of tracks each is integrated into an outer wall of the suitcase. A tray is slidably integrated into the tracks and the tray is positionable in a stored position having the tray resting against the outer wall of the suitcase. The tray is positionable in a deployed position having the tray resting on the suitcase to support food items or a laptop computer. A cup holder is integrated into the outer wall of the suitcase and the cup holder is positionable in a stored position having the cup holder resting against the outer wall of the suitcase. The cup holder is positionable in a deployed position having the cup holder extending laterally away from the suitcase to support a beverage container.

11 Claims, 6 Drawing Sheets

SUITCASE TRAY ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to tray devices and more particularly pertains to a new tray device for supporting food items or a laptop computer on a suitcase. The device includes a suitcase and a pair of tracks integrated into the suitcase. The device includes a tray that slidably engages the tracks and a cup holder that is movably integrated into the suitcase. The tray is positionable in a deployed position to define a support surface for a food item or a laptop computer. The cup holder is positionable in a deployed position for supporting a beverage container.

(2) Description of Related Art Including Information Disclosed Under 37 CFR 1.97 and 1.98

The prior art relates to tray devices including a suitcase which has an external storage pocket and a tray that is stored in the storage pocket. The prior art discloses a variety of suitcases that each includes a telescopic handle and a tray that is pivotally disposed on the telescopic handle. The prior art discloses a suitcase that includes a tray which is mounted to a pair of pivotable arms which each pivotally engage the suitcase. The prior art discloses a suitcase which includes an external panel that can be positioned in an open position to define a support surface.

(h) BRIEF SUMMARY OF THE INVENTION

An embodiment of the disclosure meets the needs presented above by generally comprising a suitcase has a pair of tracks each is integrated into an outer wall of the suitcase. A tray is slidably integrated into the tracks and the tray is positionable in a stored position having the tray resting against the outer wall of the suitcase. The tray is positionable in a deployed position having the tray resting on the suitcase to support food items or a laptop computer. A cup holder is integrated into the outer wall of the suitcase and the cup holder is positionable in a stored position having the cup holder resting against the outer wall of the suitcase. The cup holder is positionable in a deployed position having the cup holder extending laterally away from the suitcase to support a beverage container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
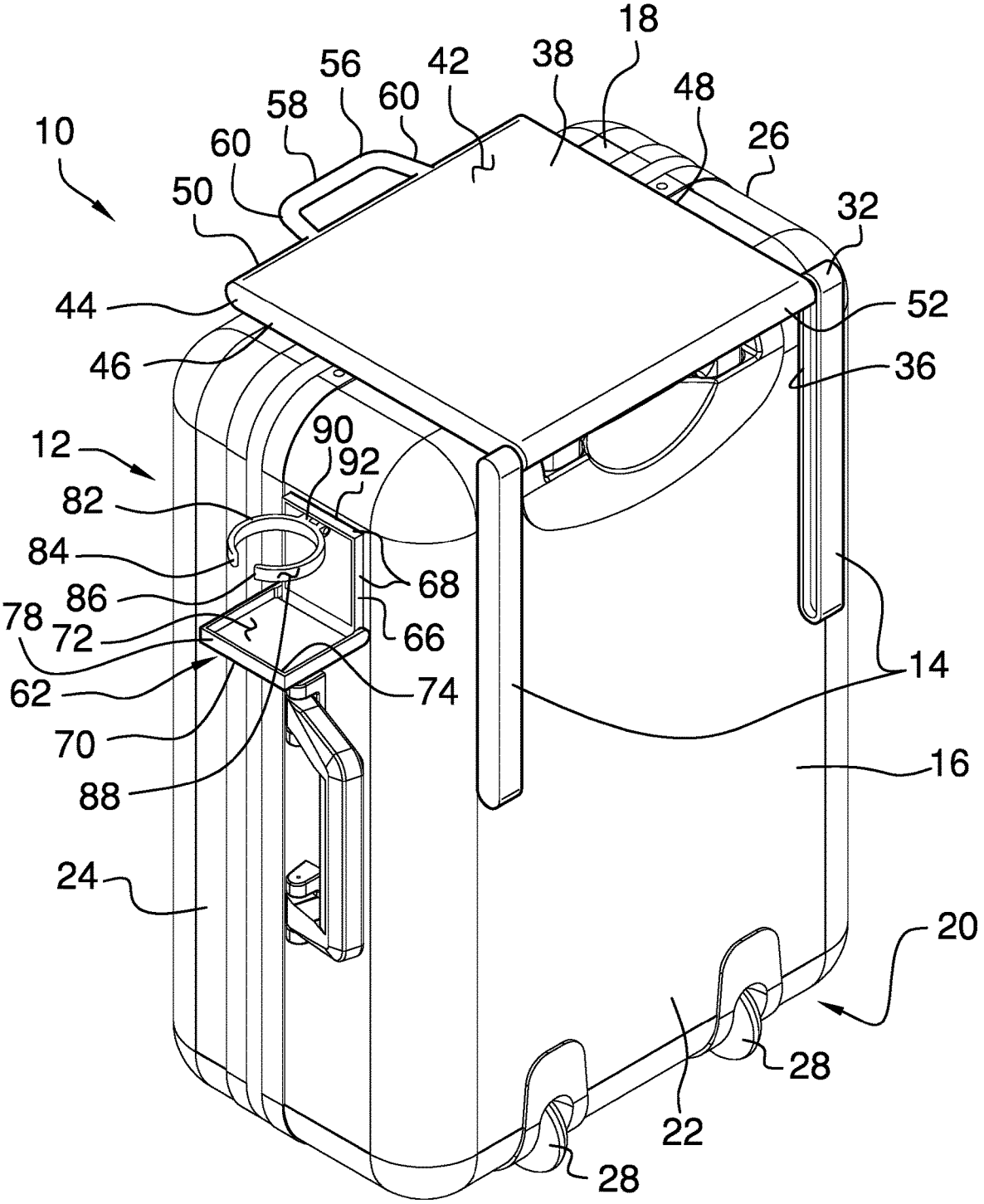
FIG. 1 is a back perspective view of a suitcase tray assembly according to an embodiment of the disclosure showing a tray and a cup holder each in a deployed position.
Figure 2:
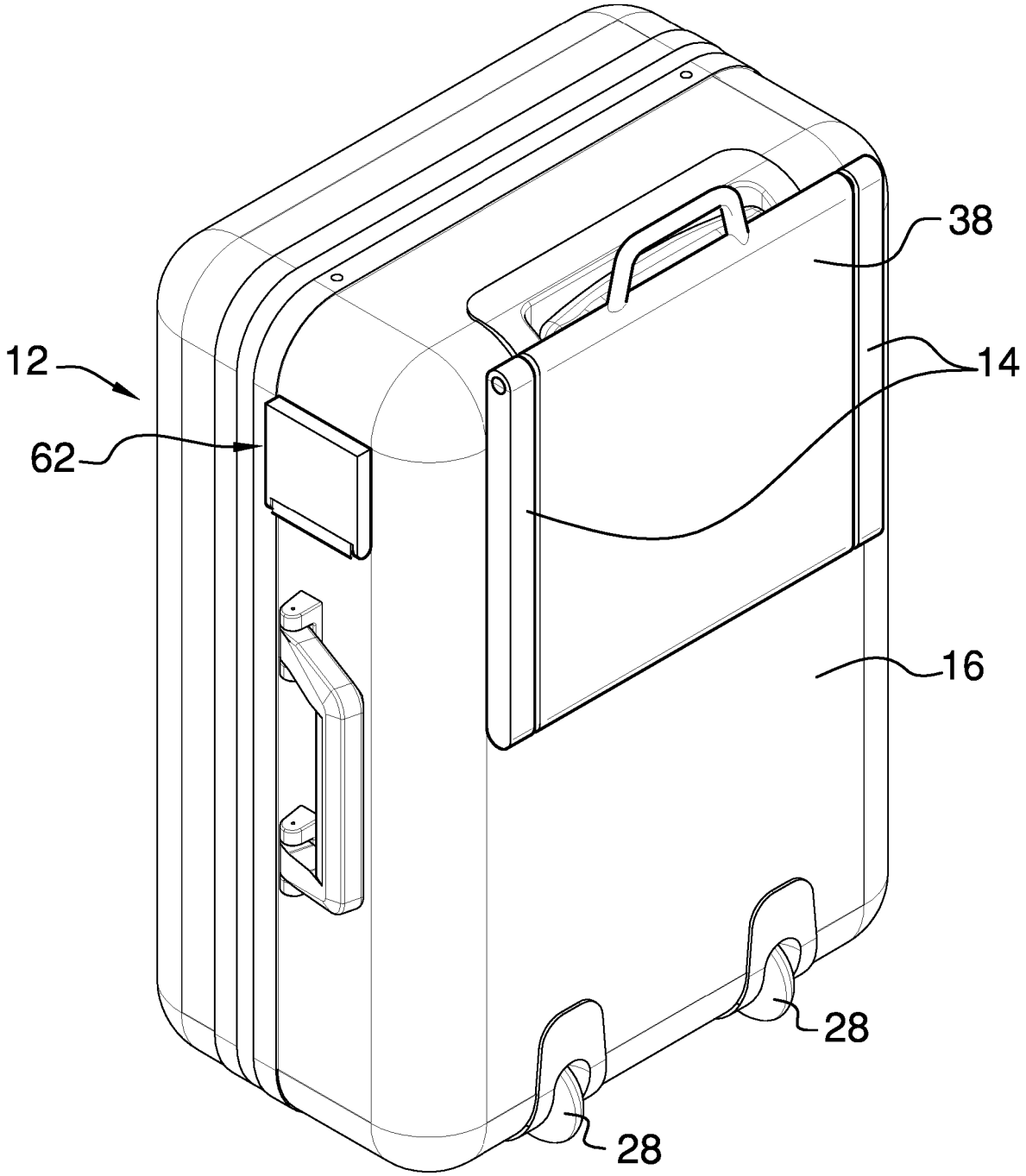
FIG. 2 is a back perspective view of an embodiment of the disclosure showing a tray and a cup holder each in a stored position.
Figure 3:
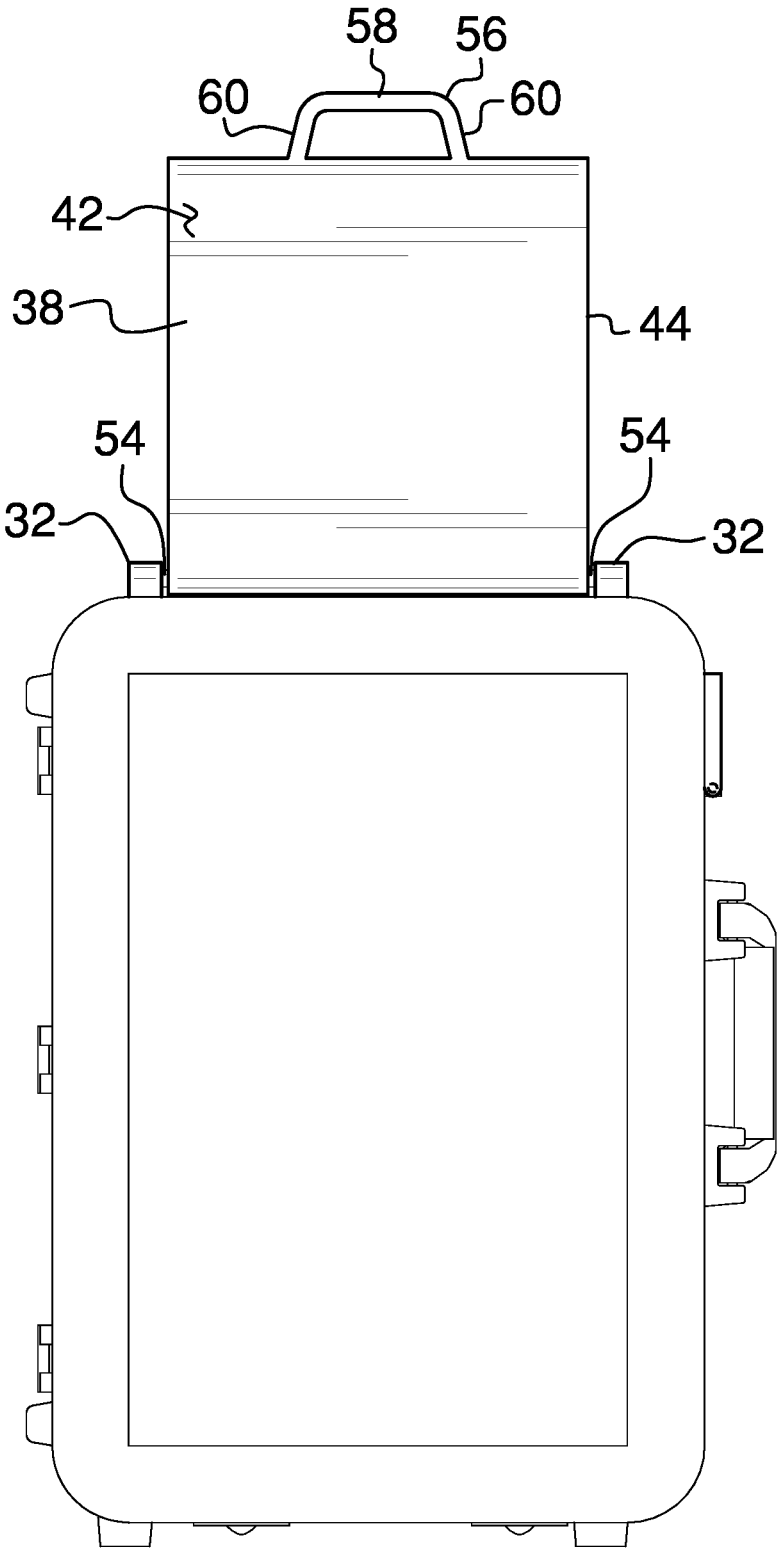
FIG. 3 is a front view of an embodiment of the disclosure showing a tray being moved into a deployed position.
Figure 4:
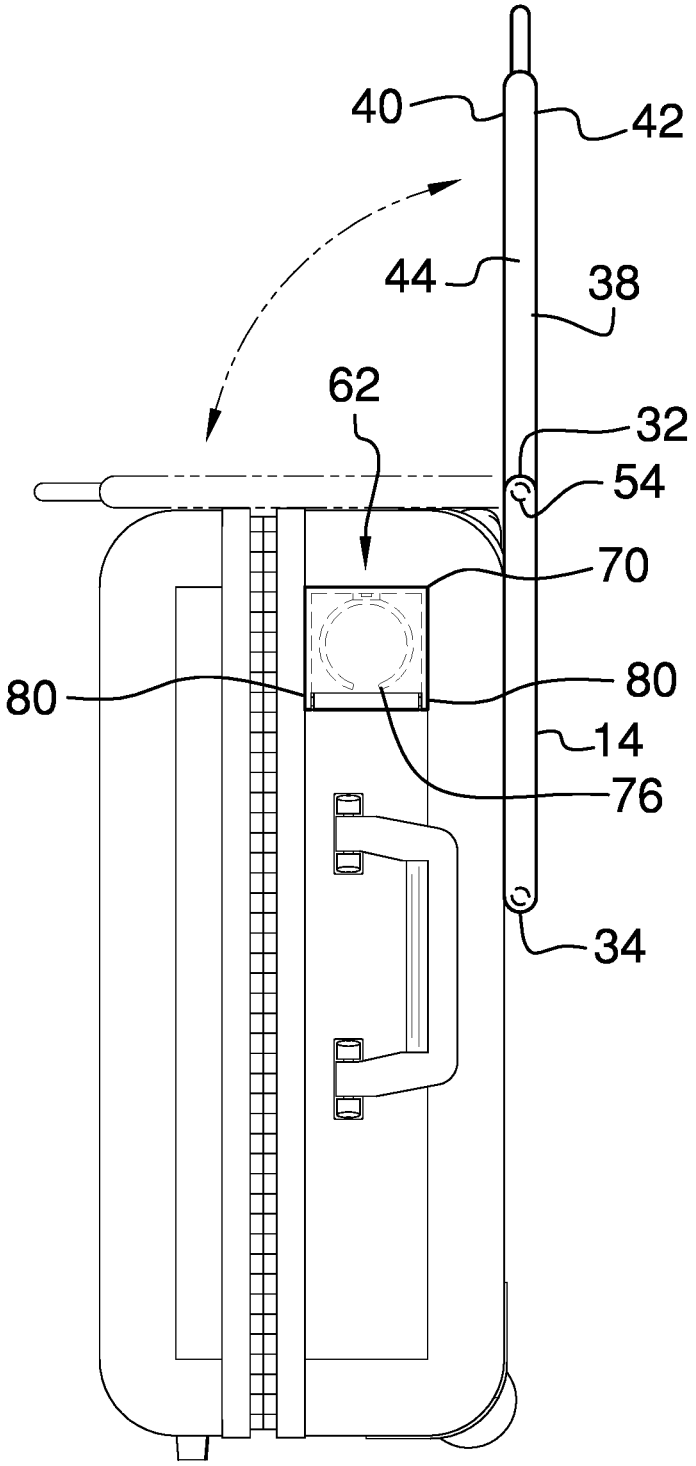
FIG. 4 is a left side view of an embodiment of the disclosure showing a tray being moved into a deployed position.
Figure 5:
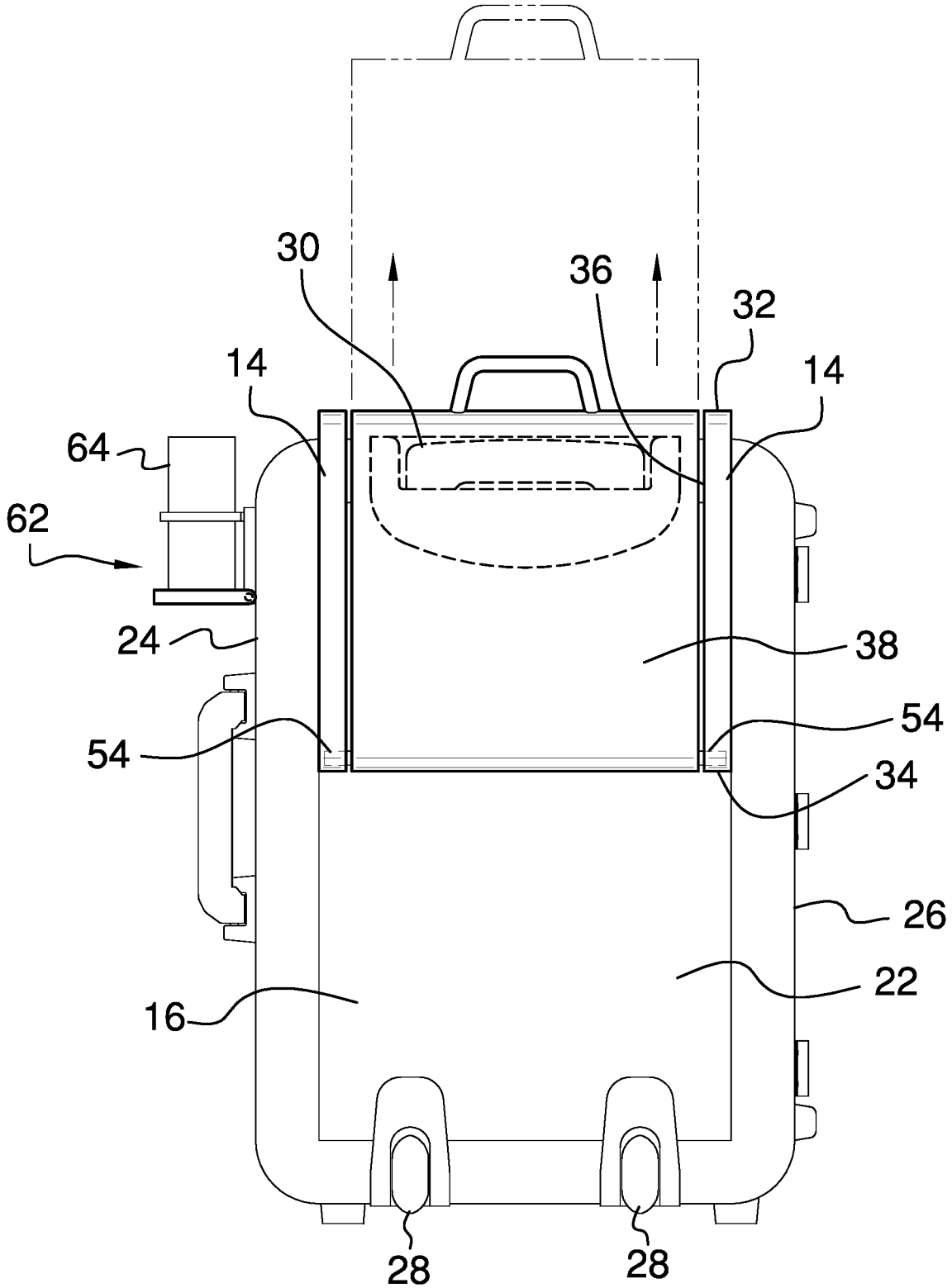
FIG. 5 is a back phantom view of an embodiment of the disclosure.
Figure 6:
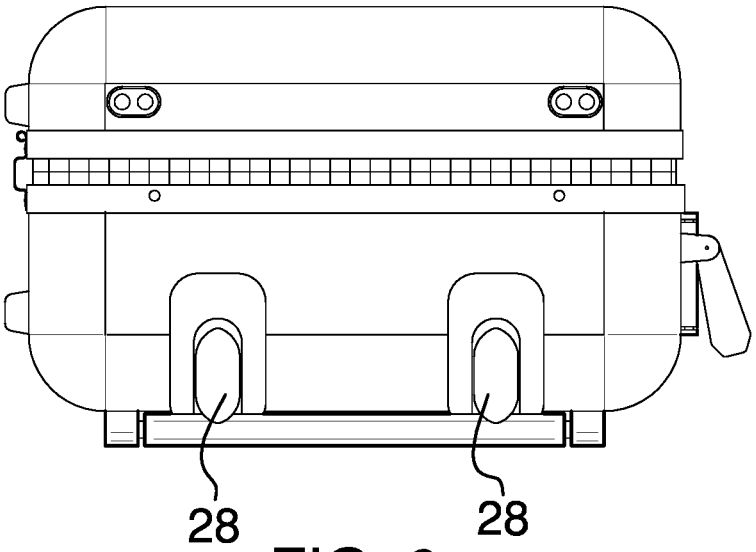
FIG. 6 is a bottom view of an embodiment of the disclosure.

With reference now to the drawings, and in particular to FIGS. 1 through 6 thereof, a new tray device embodying the principles and concepts of an embodiment of the disclosure and generally designated by the reference numeral 10 will be described.

As best illustrated in FIGS. 1 through 6, the suitcase tray assembly 10 generally comprises a suitcase 12 that has a pair of tracks 14 each being integrated into an outer wall 16 of the suitcase 12. The suitcase 12 has a top wall 18 and a bottom wall 20, and the outer wall 16 extends between the top wall 18 and the bottom wall 20. The outer wall 16 has a rear side 22, a first lateral side 24 and a second lateral side 26. The suitcase 12 might include rollers 28 and a telescopic handle 30 that are conventional to suitcases which are commonly employed for commercial air travel. Additionally, the suitcase 12 may be a hard shell suitcase with dimensions that conform to carry-on requirements of commercial airlines.

Each of the tracks 14 has an upper end 32, a lower end 34 and a first side extending between the upper end 32 and the lower end 34, and the first side of each of the tracks 14 is open into an interior of the tracks 14. Each of the tracks 14 is positioned on the rear side 22 of the outer wall 16 and each of the tracks 14 is aligned with a respective one of the first lateral side 24 and the second lateral side 26. The upper end 32 of each of the tracks 14 extend upwardly beyond the top wall 18 and the first side of each of the tracks 14 is directed toward each other. Furthermore, each of the upper end 32 and the lower end 34 of each of the tracks 14 is rounded.

A tray 38 is provided and the tray 38 is slidably integrated into the tracks 14. The tray 38 is positionable in a stored position having the tray 38 resting against the outer wall 16 of the suitcase 12. Conversely, the tray 38 is positionable in a deployed position having the tray 38 resting on the suitcase 12. In this way the tray 38 can support food items, a laptop computer or any other item that might be employed while a traveler is waiting in an airport to board an aircraft.

The tray 38 has a front surface 40, a back surface 42 and a perimeter edge 44 extending between the front surface 40 and the back surface 42. Furthermore, the perimeter edge 44 has a first lateral side 46, a second lateral side 48, an upper side 50 and a lower side 52. The tray 38 includes a pair of pins 54 each extending away from a respective one of the first lateral side 24 and the second lateral side 26 of the perimeter edge 44. Each of the pins 54 is positioned adjacent to the lower side 52 and each of the pins 54 extends into the first side of a respective one of the tracks 14.

Each of the pins 54 rests against the lower end 34 of the respective track having the front surface 40 of the tray 38 resting against the rear side 22 of the outer wall 16 of the suitcase 12 when the tray 38 is positioned in the stored position. Conversely, each of the pins 54 rests against the upper end 32 of the respective track having the front surface 40 of the tray 38 resting against the top wall 18 of the suitcase 12 when the tray 38 is in the deployed position. In this way the back surface 42 of the tray 38 can support the food item or the laptop computer. The tray 38 has a handle 56 comprising a central member 58 extending between a pair of outward members 60. Each of the outward members 60 is coupled to the upper side 50 of the tray 38 having the central member 58 being spaced from the upper side 50. In this way the central member 58 can be gripped for urging the tray 38 between the deployed position and the stored position.

A cup holder 62 is integrated into the outer wall 16 of the suitcase 12 and the cup holder 62 is positionable in a stored position has the cup holder 62 resting against the outer wall 16 of the suitcase 12. The cup holder 62 is positionable in a deployed position having the cup holder 62 extending laterally away from the suitcase 12 to support a beverage container 64. The cup holder 62 comprises a frame 66 which includes a plurality of intersecting members 68 such that the frame 66 has a rectangular shape. The frame 66 is bonded to the first lateral side 24 of the outer wall 16 of the suitcase 12 at a point that is located closer to the top wall 18 than the bottom wall 20 of the suitcase 12.

The cup holder 62 includes a panel 70 which has a primary surface 72 and an exterior edge 74, and the exterior edge 74 has a coupled side 76. The panel 70 has a lip 78 extending away from the primary surface 72 and the lip 78 is aligned with the exterior edge 74. The lip 78 extends around the exterior edge 74 excepting the coupled side 76 and the lip 78 extends beyond the coupled side 76 to define a pair of connection points 80. Each of the connection points 80 pivotally engages a respective one of the intersecting members 68 of the frame 66.

The primary surface 72 rests against the frame 66 when the cup holder 62 is in the stored position. Conversely, the panel 70 extends laterally away from the first lateral side 24 of the outer wall 16 of the suitcase 12 having the primary surface 72 lying on a horizontal plane when the cup holder 62 is in the deployed position. In this way the beverage container 64 can rest on the primary surface 72. The cup holder 62 includes a grip 82 that has a first end 84, a second end 86 and an exterior surface 88 extending between the first end 84 and the second end 86. The grip 82 is curved between the first end 84 and the second end 86 having the first end 84 being spaced from the second end 86 such that the grip 82 forms an open loop. In this way the grip 82 can be positioned around the beverage container 64.

The grip 82 has a pivot 90 that is coupled to the exterior surface 88 and the pivot 90 is centrally positioned between the first end 84 and the second end 86. The pivot 90 pivotally engages a topmost one 92 of the intersecting members 68 of the frame 66 such that the grip 82 is pivotally attached to the frame 66. The grip 82 is positionable in a stored position having the grip 82 being positioned within the frame 66 and having the grip 82 resting against the first lateral side 24 of the outer wall 16 of the suitcase 12. Conversely, the grip 82 is positionable in a deployed position having the grip 82 extending laterally away from the first lateral side 24 of the outer wall 16 of the suitcase 12 and having the grip 82 being spaced upwardly from the panel 70.

In use, the tray 38 is positioned in the deployed position to facilitate food to be positioned on the tray 38 for eating, to position a laptop computer on the tray 38 for work or for supporting any object. In this way the tray 38 facilitates a work surface while a traveler is waiting in an airport to board an aircraft. Additionally, the cup holder 62 can be positioned in the deployed position to support the beverage container 64, such as a cup, a bottle or any other cylindrical container. In this way a baby bottle, a soda bottle, a glass of water or any other type of beverage container 64 can be supported on the panel 70 and retained in the grip 82. Each of the tray 38 and the cup holder 62 are positioned in the stored position when the traveler is boarding the aircraft or when the traveler is transporting the suitcase 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A suitcase tray assembly for supporting food and drink items on a suitcase during travel, said assembly comprising:

a suitcase having a pair of tracks each being integrated into an outer wall of said suitcase, said suitcase has a top wall and a bottom wall, said outer wall extending between said top wall and said bottom wall, said outer wall having a rear side, a first lateral side and a second lateral side;

wherein each of said tracks has an upper end, a lower end and a first side extending between said upper end and said lower end, said first side of each of said tracks being open into an interior of said tracks, each of said tracks being positioned on said rear side of said outer wall, each of said tracks being aligned with a respective one of said first lateral side and said second lateral side, said upper end of each of said tracks extending upwardly beyond said top wall, said first side of each of said tracks being directed toward each other, each of said upper end and said lower end of each of said tracks being rounded a tray being slidably integrated into said tracks, said tray being positionable in a stored position having said tray resting against said outer wall of said suitcase, said tray being positionable in a deployed position having said tray resting on said suitcase wherein said tray is configured to support food items or a laptop computer, wherein said tray has a front surface, a back surface and a perimeter edge extending between said front surface and said back surface, said perimeter edge having a first lateral side, a second lateral side, an upper side and a lower side, said tray including a pair of pins each extending away from a respective one of said first lateral side and said second lateral side of said perimeter edge, each of said pins being positioned adjacent to said lower side, each of said pins extending into said first side of a respective one of said tracks;

wherein said tray has a handle comprising a central member extending between a pair of outward members, each of said outward members being coupled to said upper side of said tray having said central member being spaced from said upper side wherein said central member is configured to be gripped for urging said tray between said deployed position and said stored position, said upper side of said tray being coplanar with said top wall of said suitcase when said tray is in said stored position such that said handle on said tray extends upwardly relative to said top wall of said suitcase when said tray is in said stored position; and a cup holder being integrated into said outer wall of said suitcase, said cup holder being positionable in a stored position having said cup holder resting against said outer wall of said suitcase, said cup holder being positionable in a deployed position having said cup holder extending laterally away from said suitcase wherein said cup holder is configured to support a beverage container.

2. The assembly according to claim 1, wherein each of said pins rests against said lower end of said respective track having said front surface of said tray resting against said rear side of said outer wall of said suitcase when said tray is positioned in said stored position.

3. The assembly according to claim 1, wherein each of said pins rests against said upper end of said respective track having said front surface of said tray resting against said top wall of said suitcase when said tray is in said deployed position wherein said back surface of said tray is configured to support the food item or the laptop computer.

4. The assembly according to claim 1, wherein said cup holder comprises a frame comprising a plurality of intersecting members such that said frame has a rectangular shape, said frame being bonded to said to said first lateral side of said outer wall of said suitcase at a point being located closer to said top wall than said bottom wall of said suitcase.

5. The assembly according to claim 4, wherein said cup holder comprises a panel having a primary surface and an exterior edge, said exterior edge having a coupled side, said panel having a lip extending away from said primary surface, said lip being aligned with said exterior edge, said lip extending around said exterior edge excepting said coupled side, said lip extending beyond said coupled side to define a pair of connection points, each of said connection points pivotally engaging a respective one of said intersecting members of said frame.

6. The assembly according to claim 5, wherein said primary % surface rests against said frame when said cup holder is in said stored position.

7. The assembly according to claim 5, wherein said panel extends laterally away from said first lateral side of said outer wall of said suitcase having said primary surface lying on a horizontal plane when said cup holder is in said deployed position wherein said primary surface is configured to have the beverage container resting on said primary surface.

8. The assembly according to claim 4, wherein said cup holder includes a grip having a first end, a second end and an exterior surface extending between said first end and said second end, said grip being curved between said first end and said second end having said first end being spaced from said second end such that said grip forms an open loop wherein said grip is configured to be positioned around the beverage container, said grip having a pivot being coupled to said exterior surface, said pivot being centrally positioned between said first end and said second end, said pivot pivotally engaging a topmost one of said intersecting members of said from such that said grip is pivotally attached to said frame.

9. The assembly according to claim 8, wherein said grip is positionable in a stored position having said grip being positioned within said frame having said grip resting against said first lateral side of said outer wall of said suitcase.

10. The assembly according to claim 9, wherein said grip is positionable in a deployed position having said grip extending laterally away from said first lateral side of said outer wall of said suitcase having said grip being spaced upwardly from said panel.

11. A suitcase tray assembly for supporting food and drink items on a suitcase during travel, said assembly comprising:

a suitcase having a pair of tracks each being integrated into an outer wall of said suitcase, said suitcase having a top wall and a bottom wall, said outer wall extending between said top wall and said bottom wall, said outer wall having a rear side, a first lateral side and a second lateral side, each of said tracks having an upper end, a lower end and a first side extending between said upper end and said lower end, said first side of each of said tracks being open into an interior of said tracks, each of said tracks being positioned on said rear side of said outer wall, each of said tracks being aligned with a respective one of said first lateral side and said second lateral side, said upper end of each of said tracks extending upwardly beyond said top wall, said first side of each of said tracks being directed toward each other, each of said upper end and said lower end of each of said tracks being rounded;

a tray being slidably integrated into said tracks, said tray being positionable in a stored position having said tray resting against said outer wall of said suitcase, said tray being positionable in a deployed position having said tray resting on said suitcase wherein said tray is configured to support food items or a laptop computer, said tray having a front surface, a back surface and a perimeter edge extending between said front surface and said back surface, said perimeter edge having a first lateral side, a second lateral side, an upper side and a lower side, said tray including a pair of pins each extending away from a respective one of said first lateral side and said second lateral side of said perimeter edge, each of said pins being positioned adjacent to said lower side, each of said pins extending into said first side of a respective one of said tracks, each of said pins resting against said lower end of said respective track having said front surface of said tray resting against said rear side of said outer wall of said suitcase when said tray is positioned in said stored position, each of said pins resting against said upper end of said respective track having said front surface of said tray resting against said top wall of said suitcase when said tray is in said deployed position wherein said back surface of said tray is configured to support the food item or the laptop computer, said tray having a handle comprising a central member extending between a pair of outward members, each of said outward members being coupled to said upper side of said tray having said central member being spaced from said upper side wherein said central member is configured to be gripped for urging said tray between said deployed position and said stored position, said upper side of said tray being coplanar with said top wall of said suitcase when said tray is in said stored position such that said handle on said tray extends upwardly relative to said top wall of said suitcase when said tray is in said stored position; and a cup holder being integrated into said outer wall of said suitcase, said cup holder being positionable in a stored position having said cup holder resting against said outer wall of said suitcase, said cup holder being positionable in a deployed position having said cup holder extending laterally away from said suitcase wherein said cup holder is configured to support a beverage container, said cup holder comprising:

a frame comprising a plurality of intersecting members such that said frame has a rectangular shape, said frame being bonded to said to said first lateral side of said outer wall of said suitcase at a point being located closer to said top wall than said bottom wall of said suitcase;

a panel having a primary surface and an exterior edge, said exterior edge having a coupled side, said panel having a lip extending away from said primary surface, said lip being aligned with said exterior edge, said lip extending around said exterior edge excepting said coupled side, said lip extending beyond said coupled side to define a pair of connection points, each of said connection points pivotally engaging a respective one of said intersecting members of said frame, said primary surface resting against said frame when said cup holder is in said stored position, said panel extending laterally away from said first lateral side of said outer wall of said suitcase having said primary surface lying on a horizontal plane when said cup holder is in said deployed position wherein said primary surface is configured to have the beverage container resting on said primary surface; and a grip having a first end, a second end and an exterior surface extending between said first end and said second end, said grip being curved between said first end and said second end having said first end being spaced from said second end such that said grip forms an open loop wherein said grip is configured to be positioned around the beverage container, said grip having a pivot being coupled to said exterior surface, said pivot being centrally positioned between said first end and said second end, said pivot pivotally engaging a topmost one of said intersecting members of said from such that said grip is pivotally attached to said frame, said grip being positionable in a stored position having said grip being positioned within said frame having said grip resting against said first lateral side of said outer wall of said suitcase, said grip being positionable in a deployed position having said grip extending laterally away from said first lateral side of said outer wall of said suitcase having said grip being spaced upwardly from said panel.

* * * * *